US009821355B2

(12) United States Patent
Tanoue et al.

(10) Patent No.: US 9,821,355 B2
(45) **Date of Patent: *Nov. 21, 2017**

(54) METHOD OF MANUFACTURING RECTANGULAR TUBE HAVING STEPPED PORTION

(71) Applicant: NISSHIN STEEL CO., LTD., Tokyo (JP)

(72) Inventors: Ryuji Tanoue, Sakai (JP); Hirokazu Sasaki, Sakai (JP); Naofumi Nakamura, Sakai (JP); Jun Kurobe, Sakai (JP)

(73) Assignee: NISSHIN STEEL CO., LTD., Tokyo (JP)

( * ) Notice: Subject to any disclaimer, the term of this patent is extended or adjusted under 35 U.S.C. 154(b) by 153 days.

This patent is subject to a terminal disclaimer.

(21) Appl. No.: 14/229,440

(22) Filed: Mar. 28, 2014

(65) Prior Publication Data

US 2015/0273548 A1 Oct. 1, 2015

Related U.S. Application Data

(63) Continuation of application No. PCT/JP2012/074870, filed on Sep. 27, 2012.

(30) Foreign Application Priority Data

Sep. 30, 2011 (JP) ..... 2011-217072

(51) Int. Cl.
*B21C 37/15* (2006.01)
*B21C 37/20* (2006.01)
(Continued)

(52) U.S. Cl.
CPC ..... *B21C 37/154* (2013.01); *B21C 37/155* (2013.01); *B21C 37/202* (2013.01);
(Continued)

(58) Field of Classification Search
CPC ..... B21D 17/02; B21D 17/08; B21D 41/04; B21D 27/024; B21D 41/045; B21C 5/00;
(Continued)

(56) References Cited

U.S. PATENT DOCUMENTS 1,979,430 A * 11/1934 Wright ..... B21D 15/02 428/34.1
1,983,074 A * 12/1934 Durell ..... B21D 15/02 428/34.1
(Continued)

FOREIGN PATENT DOCUMENTS

CA 2283734 A1 9/1998
CN 1136479 A 11/1996
(Continued)

OTHER PUBLICATIONS

Office Action dated Apr. 3, 2015, in counterpart Chinese Patent Application No. 201280047837.0, 5 pages.
(Continued)

*Primary Examiner* — Teresa M Ekiert
*Assistant Examiner* — Gregory Swiatocha
(74) *Attorney, Agent, or Firm* — Tracy Heims; Apex Juris, pllc.

(57) ABSTRACT

A method of manufacturing a rectangular tube having a stepped portion includes: forming V-shaped grooves on a rectangular tube at surfaces of an end thereof in a direction parallel to a longitudinal direction thereof; and pressing each of the surfaces having the V-shaped grooves formed thereon with a rotating roll from outside to inside, whereby the end of the rectangular tube is radially reduced.

4 Claims, 8 Drawing Sheets

(51) Int. Cl.

| | |
|---|---|
| ***B21D 17/04*** | (2006.01) |
| ***B21D 41/04*** | (2006.01) |
| ***B21C 5/00*** | (2006.01) |
| ***B21K 21/12*** | (2006.01) |
| ***B21D 17/02*** | (2006.01) |

(52) U.S. Cl.
CPC ..... *B21D 17/04* (2013.01); *B21D 41/04* (2013.01); *B21C 5/00* (2013.01); *B21C 5/003* (2013.01); *B21D 17/02* (2013.01); *B21K 21/12* (2013.01)

(58) Field of Classification Search
CPC ... B21C 5/003; B21C 37/0803; B21C 37/104; B21C 37/155; B21J 5/022; B21J 9/022; B21J 9/025; B21J 13/025
USPC ..... 72/370.01, 370.02, 370.04, 370.13, 72/370.03, 370.12, 367.1, 368, 370.26, 72/370.21
See application file for complete search history.

(56) References Cited

U.S. PATENT DOCUMENTS

| | | | | | |
|---|---|---|---|---|---|
| 1,994,725 | A | * | 3/1935 | Offutt | B21D 41/04 165/177 |
| 2,055,771 | A | * | 9/1936 | McLaughlin | B21C 1/22 428/595 |
| 3,042,099 | A | * | 7/1962 | Neely | B21D 7/06 72/369 |
| 3,144,070 | A | * | 8/1964 | Mieszczak | B21C 5/00 72/370.12 |
| 3,370,451 | A | * | 2/1968 | Schuetz | B21C 5/00 72/402 |
| 3,399,559 | A | * | 9/1968 | Mitchell | B21C 5/00 72/294 |
| 4,350,036 | A | * | 9/1982 | Valente | B21C 5/00 72/402 |
| 4,982,487 | A | | 1/1991 | Maruko et al. | |
| 5,907,969 | A | * | 6/1999 | Soder | B21D 41/04 72/208 |
| 6,757,974 | B2 | | 7/2004 | Kido | |
| 8,833,127 | B2 | | 9/2014 | Tomizawa | |
| 2004/0139777 | A1 | | 7/2004 | Waldrop | |
| 2015/0273558 | A1 | | 10/2015 | Tanoue et al. | |

FOREIGN PATENT DOCUMENTS

| | | | | | |
|---|---|---|---|---|---|
| CN | 2426774 | Y | | 4/2001 | |
| CN | 1745930 | A | | 3/2006 | |
| CN | 102172724 | A | | 9/2011 | |
| IT | WO 2010013273 | A1 | * | 2/2010 | B21C 37/155 |
| JP | 49-6037 | B1 | | 2/1974 | |
| JP | P491974-6037 | B1 | | 2/1974 | |
| JP | 49-29628 | Y1 | | 8/1974 | |
| JP | 52-12768 | Y2 | | 3/1977 | |
| JP | 58-187224 | A | | 11/1983 | |
| JP | 58187224 | A | * | 11/1983 | |
| JP | P581983187224 | A | | 11/1983 | |
| JP | S58187224 | A | | 11/1983 | |
| JP | U061994-19938 | Y1 | | 3/1994 | |
| JP | P 2001-522310 | A | | 11/2001 | |
| JP | P3359947 | B2 | | 10/2002 | |
| WO | 2010-021553 | A1 | | 2/2010 | |

OTHER PUBLICATIONS

English translation of the body text of the Office Action dated Apr. 3, 2015, in counterpart Chinese Patent Application No. 201280047837.0, 3 pages.
Office Action dated Sep. 25, 2015, in counterpart Chinse Patent Application No. 201280047837.0, 5 pages.
English translation of the body text of the Office Action dated Sep. 25, 2015, in counterpart Chinse Patent Application No. 201280047837.0, 2 pages.
Office Action dated May 23, 2016, in Chinese Application No. 201280047837.0, with English translation, 9 pages.
Office Action dated Aug. 5, 2016, in counterpart Australia Patent Application No. 2012317495, 3 pages.
Office Action dated Dec. 30, 2015; U.S. Appl. No. 14/229,351; 9 pages.
Final Office Action dated May 11, 2016; U.S. Appl. No. 14/229,351; 8 pages.
Office Action dated Apr. 1, 2015, in Chinese Patent Application No. 201280047618.2, with English translation, 11 pages.
Office Action dated Oct. 26, 2015, in Chinese Patent Application No. 201280047618,2, with English translation, 7 pages.
Office Action dated Jul. 27, 2016, in Taiwanese Patent Application No. 101135477, 8 pages.
Office Action for U.S. Appl. No. 14/229,351 dated Jan. 6, 2017.

* cited by examiner

METHOD OF MANUFACTURING RECTANGULAR TUBE HAVING STEPPED PORTION

CROSS REFERENCE TO RELATED APPLICATIONS

This is a continuation application of International Patent Application No. PCT/JP2012/074870 filed on Sep. 27, 2012 claiming priority upon Japanese Patent Application No. 2011-217072 filed on Sep. 30, 2011, of which full contents are incorporated herein by reference.

BACKGROUND OF THE INVENTION

Field of the Invention

The present invention relates to a method of manufacturing a rectangular tube having a stepped portion for connection formed at an end thereof.

Description of the Background Art

The rectangular construction tubes used for fences or barriers have been generally assembled in such a fashion that a plurality of rectangular tube members each having a predetermined length are formed, and thereafter, the plurality of formed rectangular tube members are butted one another, and the formed rectangular tube members abutting one another are fixed through connection members. However, the use of connection members has caused increase in component count and cost. Furthermore, the use of such connection members has sometimes caused an undesirable appearance.

For the purpose of reducing cost, there has been proposed a method of: radially reducing an end of one rectangular tube; and inserting the radially reduced end into an end (non-radially reduced end) of another rectangular tube so as to connect the rectangular tubes (see patent document 1).

For example, patent document 1 proposes a method of: radially reducing an end of one round tube through the use of a die; connecting the radially reduced end with an end (non-radially reduced end) of another round tube; and thereafter, forming the connected round tubes into a rectangular tube by roll forming.

In the roll forming described in patent document 1, a plurality of roll stands equipped with rolls each having a predetermined dimension are installed around the connected round tubes. Such connected round tubes are inserted into the rolls so as to form a rectangular tube having a predetermined dimension. Rectangular tube members manufactured by such a method are used for fences or barriers.

PRIOR ART DOCUMENT

Patent Document

Patent Document 1: Japanese Patent No. 3359947

Problems to be Solved

The method proposed in patent document 1 has required at least: the step of manufacturing a round tube at roll stands; the step of radially reducing one end of the round tube off-line; the step of connecting a plurality of round tubes; the step of returning the connected round tubes to the roll stands; and the step of forming the connected round tubes into a rectangular tube.

Generally, a rectangular tube has been manufactured by: making a round tube at roll stands; and thereafter, continuously passing the round tube through roll stands so as to form the round tube into a rectangular tube. In other words, if the method proposed by patent document 1 is adopted, an activity to transfer the round tubes to the station where the tube-radially reducing step is carried out would be required at the timing after the round tubes are manufactured at the roll stands before the round tubes are formed into the rectangular tubes, which would cause a problem that the burden of product management and process management regarding the round tubes is increased. Furthermore, since the round tubes are radially reduced by inserting such round tubes into a die, dies corresponding to the outer diameter of the round tube as well as the dimension of radially reduced end thereof would have to be prepared, which would cause another problem that the cost for such dies is increased.

SUMMARY OF THE INVENTION

The present invention is come up with in order to solve the above problems. The object of the present invention is to propose a method of manufacturing a rectangular tube having a stepped portion at an end thereof, whose appearance is desirable, by carrying out a simple manufacturing step through the use of an easy-to-use device at low cost.

Means for Solving Problems

The method of manufacturing a rectangular tube having a stepped portion according to the present invention is characterized by comprising: forming V-shaped grooves on a rectangular tube at surfaces of an end thereof in a direction parallel to a longitudinal direction thereof; and pressing each of the surfaces having the V-shaped grooves formed thereon with a rotating roll from outside to inside, whereby the end of the rectangular tube is radially reduced.

It is preferable that the above step of forming the V-shaped grooves on the rectangular tube at the surfaces of the end thereof comprises the following step of: placing an internal die having a V-shaped concave portion formed thereon inside the end of the rectangular tube; placing a V-shaped roll having a V-shaped convex portion formed thereon at a position that is opposite to the concave portion and is outside the end of the rectangular tube; and pressing the V-shaped roll against the rectangular tube at each of the surfaces of the end thereof while causing the V-shaped roll to rotate.

Further, it is preferable that the end of the rectangular tube is radially reduced by: shifting a relative position of the rotating roll with respect to the rectangular tube in an longitudinal direction thereof while keeping a status that the rectangular tube is pressed with the rotating roll from outside to inside.

Advantageous Effects of the Invention

According to the present invention, the radially reduced portion is formed on the rectangular tube at the end thereof by forming the V-shaped grooves on the rectangular tube at the surfaces of the end thereof in a direction parallel to the longitudinal direction thereof in advance, and pressing each of the surfaces of the end thereof through the use of a flat external die. Using this method, there is no need to transport a round tube to the station where a tube-radially reducing step is carried out before the round tube is formed into the rectangular tube. Further, in the tube-radially reducing step, there is no need to prepare the dies corresponding to the outer diameter of the round tube and the dimension of the radially reduced end thereof, but two roll stands and a device for rotating and shifting the rectangular tubes are sufficient for the tube-radially reducing step. Accordingly, not only the tube-radially reducing step can become simpler but also the rectangular tube having a stepped portion of excellent appearance can be obtained. In particular, this method can render the maintenance as being easier in comparison with the method using a die.

Still further, the radially reduced portion formed on the rectangular tube at the end thereof has a shape corresponding to a cross-sectional shape thereof, and is used as a good connection portion. A plurality of rectangular tubes can therefore be connected by simply fitting the radially reduced end of one tube in the open end of another tube, thereby enabling easy construction of high quality fences and barriers designed to harmonize with the adjacent buildings.

BRIEF DESCRIPTION OF THE DRAWINGS

For more thorough understanding of the present invention and advantages thereof, the following descriptions should be read in conjunction with the accompanying drawings, in which.

DESCRIPTION OF EMBODIMENTS OF THE INVENTION

The inventors have studied a forming method of forming a radially reduced portion formed on a rectangular tube at the end thereof with superior forming precision at low cost, and a connecting method of connecting two rectangular tube members by inserting one rectangular tube having a stepped portion, which is manufactured by the forming method, into the end (at which a radially reduced end is not formed) of another rectangular tube.

When a rectangular tube is formed with a radially reduced portion at the end thereof, which is rectangular in cross section, there are many embodiments that two edges opposite to each other at the end of the rectangular tube are pressed from outside to inside. However, the other two edges (two non-pressed edges) adjacent to the two pressed edges are bent outward to the extent that a distance between the two pressed edges is shortened. Furthermore, the two initially pressed edges are bent outward by subsequently pressing the other two bent edges. For this reason, each edge of the radially reduced rectangular tube at the end thereof is bent, which makes it difficult to insert the radially reduced end of one rectangular tube into the non-radially reduced end of another rectangular tube when connecting two rectangular tubes.

In the present invention, therefore, V-shaped grooves are formed on an outer surface of a rectangular tube in a direction parallel to a longitudinal direction of the rectangular tube before pressing two opposite edges of the rectangular tube from outside to inside. A processing method of processing the rectangular tube in such a fashion that the V-shaped grooves are formed thereon will be described with reference to FIGS. 1 to 3.

Figure 1:
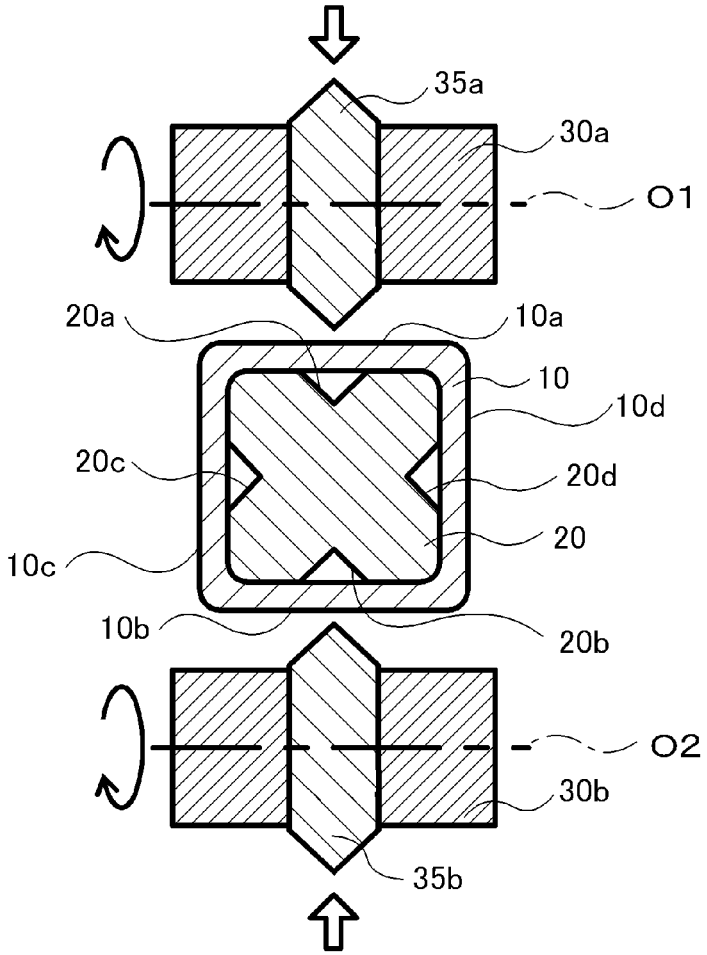
FIG. 1 depicts a view showing an end of a rectangular tube having an internal die inserted therein, and V-shaped rolls.

Initially, an internal die (20) having V-shaped concave portions (20*a*, 20*b*, 20*c*, 20*d*) formed on an outer surface thereof is inserted into an end of a rectangular tube (10) (see FIG. 1). Subsequently, V-shaped external dies (30*a*, 30*b*) having V-shaped convex portions (35*a*, 35*b*) formed on their respective surfaces are arranged across the rectangular tube (10) such that the V-shaped convex portions (35*a*, 35*b*) are opposite to the concave portions (20*a*, 20*b*, 20*c*, 20*d*) of the internal die (20). In FIG. 1, the V-shaped roll (30*a*) is arranged such that the V-shaped convex portion (35*a*) thereof is opposite to the concave portion (20*a*) of the internal die, and the V-shaped roll (30*b*) is arranged such that the V-shaped convex portion (35*b*) thereof is opposite to the concave portion (20*b*) of the internal die. In such a configuration, a rotation centerline (O1) of the V-shaped roll (30*a*) is substantially perpendicular to the longitudinal direction of the rectangular tube (10) and substantially parallel to an outer surface (10*a*) out of outer surfaces (10*a*-10*d*) of the rectangular tube (10). In a similar fashion, a rotation centerline (O2) of the V-shaped roll (30*b*) is substantially perpendicular to the longitudinal direction of the rectangular tube (10) and substantially parallel to an outer surface (10*b*) out of the outer surfaces (10*a*-10*d*) of the rectangular tube (10).

Figure 2:
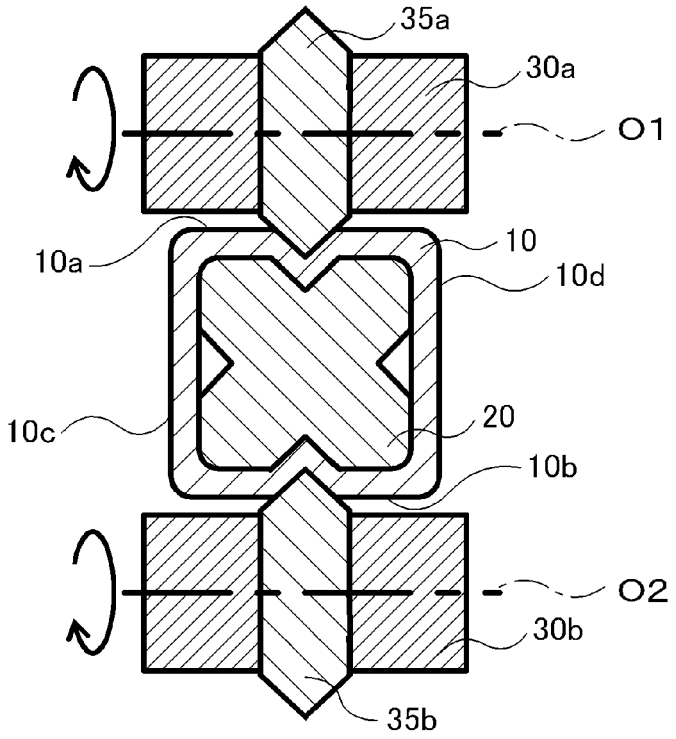
FIG. 2 depicts a view showing one step of forming V-shaped grooves on the rectangular tube at the end thereof.

Subsequently, as shown in FIG. 2, the V-shaped roll (30*a*) is brought close to and pressed against the outer surface (10*a*) of the rectangular tube (10) at the end thereof while the V-shaped roll (30*a*) is caused to rotate, and the V-shaped roll (30*b*) is brought close to and pressed against the outer surface (10*b*) of the rectangular tube (10) at the end thereof while the V-shaped roll (30*b*) is caused to rotate. As a result, on the outer surfaces (10*a*, 10*b*) of the rectangular tube (10) at the end thereof, V-shaped grooves in conformity with the concave portions (20*a*-20*d*) of the internal die (20) placed inside the rectangular tube (10) are formed. In FIG. 2, reference numerals of the concave portions (20*a*-20*d*) are omitted for the sake of convenience (see FIG. 1 for reference numerals of the concave portions (20*a*-20*d*)).

Figure 3:
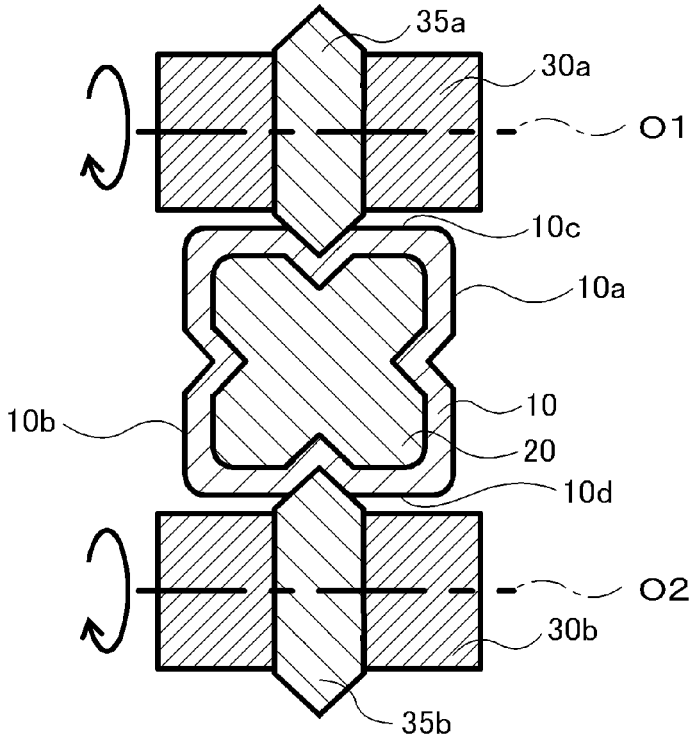
FIG. 3 depicts a view showings further step of forming V-shaped grooves on the rectangular tube at the end thereof.

Subsequently, the rectangular tube (10) is rotated approximately 90 degrees around the longitudinal direction thereof as a center of rotation. Subsequently, as shown in FIG. 3, on outer surfaces (10*c*, 10*d*) having no V-shaped formed thereon of the rectangular tube (10), V-shaped grooves in conformity with the concave portions (20*a*-20*d*) of the internal die (20) are formed in a similar fashion. In FIG. 3, reference numerals of the concave portions (20*a*-20*d*) are omitted for the sake of convenience (see FIG. 1 for reference numerals of the concave portions (20*a*-20*d*)).

Figure 4:
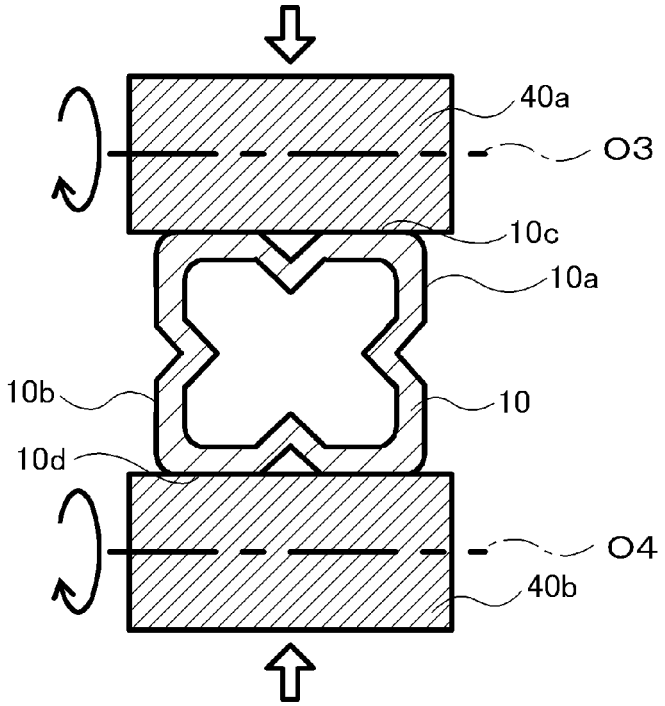
FIG. 4 depicts a view showing one step of pressing the end of the rectangular tube having the V-shaped grooves formed thereon.
Figure 5:
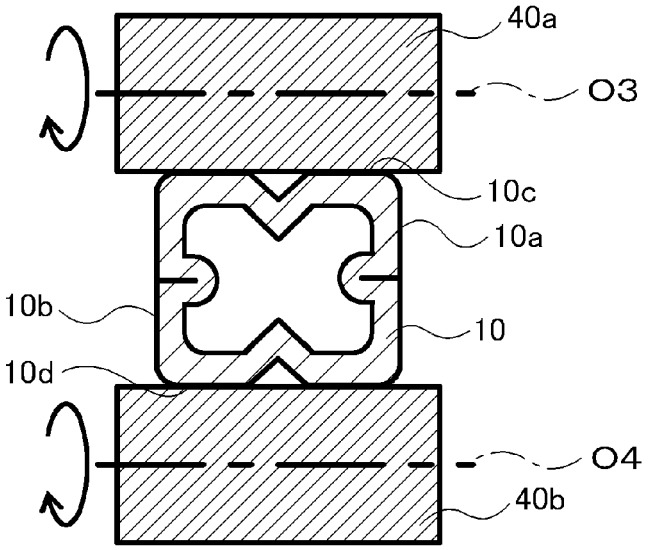
FIG. 5 depicts a view showing further step of pressing the end of the rectangular tube having the V-shaped grooves formed thereon.
Figure 6:
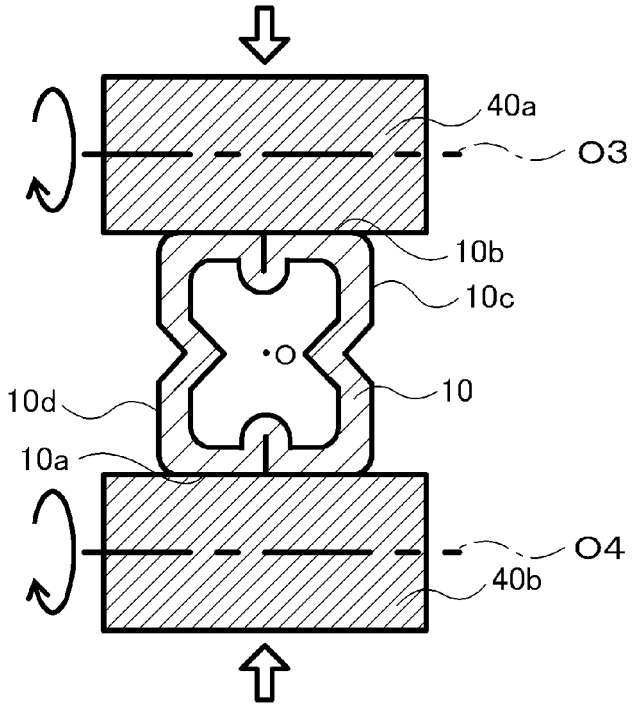
FIG. 6 depicts a view showing still further step of pressing the end of the rectangular tube having the V-shaped grooves formed thereon.

After the V-shaped grooves are formed on the outer surfaces (10*a*-10*d*) of the rectangular tube (10) as shown in FIGS. 1-3, the internal die (20) is pulled out from the rectangular tube (10). Subsequently, as shown in FIGS. 4-6, flat rolls (40*a*, 40*b*) are arranged so as to interpose the rectangular tube (10) therebetween (from the upper side to the lower side in FIGS. 4-6). Unlike the V-shaped rolls (30*a*, 30*b*) having the convex portions formed on their respective surfaces thereof, the flat rolls (40*a*, 40*b*) have a substantially constant outside diameter over a length in the longitudinal direction. In FIG. 4, the flat roll (40*a*) is arranged such that the flat roll (40*a*) faces the outer surface (10*c*) of the rectangular tube (10), and the flat roll (40*b*) is arranged such that the flat roll (40*b*) faces the outer surface (10*d*) of the rectangular tube (10). In such a configuration, a rotation centerline (O3) of the flat roll (40*a*) is substantially perpendicular to the longitudinal direction of the rectangular tube (10) and substantially parallel to the outer surface (10*c*) of the rectangular tube (10). In a similar fashion, a rotation centerline (O4) of the flat roll (40*b*) is substantially perpendicular to the longitudinal direction of the rectangular tube (10) and substantially parallel to the outer surface (10*d*) of the rectangular tube (10).

Figure 7:
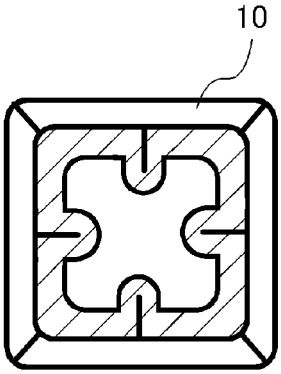
FIG. 7 depicts a view showing a radially reduced portion formed on the rectangular tube at the end thereof.
Figure 8:
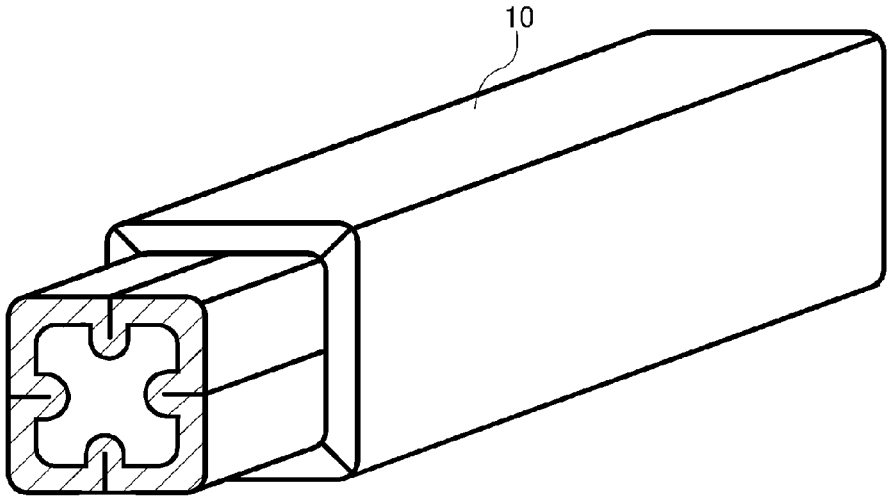
FIG. 8 depicts a perspective view showing the rectangular tube having a radially reduced portion formed at the end thereof.

Subsequently, the flat rolls (40*a*, 40*b*) are shifted in arrow directions in FIG. 4 so as to be pressed against the rectangular tube (10) having the V-shaped grooves formed thereon from outside to inside. Accordingly, as shown in FIG. 5, the V-shaped grooves on the outer surfaces (10*a*, 10*b*) of the rectangular tube (10) not facing the flat rolls (40*a*, 40*b*) are closed so that only a portion having the V-shaped grooves formed thereon out of a whole portion of the end of the rectangular tube (10) along a longitudinal direction can be radially reduced. After, as shown in FIG. 6, the rectangular tube (10) is rotated approximately 90 degrees around the center (0) of the cross-section across a longitudinal direction of the rectangular tube (10), which is regarded as substantially a center of rotation, the flat rolls (40*a*, 40*b*) are shifted in arrow directions in FIG. 6 so as to be pressed against the not-yet-radially reduced outer surfaces (10*c*, 10*d*) of the rectangular tube (10) from outside to inside in a similar fashion. As a result, as shown in FIGS. 7 and 8, the rectangular tube (10) having a stepped portion for connection formed at the end thereof can be obtained.

In such a fashion, by virtue of forming the V-shaped grooves in advance on the outer surfaces (10*a*-10*d*) of the end of the rectangular tube (10), the V-shaped grooves formed on the two surfaces not facing the flat rolls (40*a*, 40*b*) are deformed so as to be closed therealong, when the rectangular tube (10) is pressed against from opposite outsides to inside, thereby suppressing the bending of the radially reduced end of the rectangular tube (10), and further suppressing a concavo-convex crimp likely to be generated on the radially reduced end. As a result, a rectangular tube having a stepped portion with high dimensional accuracy can be obtained.

In particular, a crimp likely to be generated on the radially reduced portion can be further suppressed by shifting relative positions of the rotating flat rolls (40*a*, 40*b*) with respect to the rectangular tube (10) in the longitudinal direction thereof while keeping a status that the rectangular tube (10) is pressed with the rotating flat rolls (40*a*, 40*b*) from opposite outsides when forming a radially reduced portion at the end of the rectangular tube (10). In such a radially reducing step, the relative positions of the flat rolls (40*a*, 40*b*) with respect to the rectangular tube (10) may be shifted from the end of the rectangular tube (10) at a side to be radially reduced toward the other side not to be radially reduced. However, it is preferable that the relative positions of the flat rolls (40*a*, 40*b*) with respect to the rectangular tube (10) are shifted toward the end of the rectangular tube (10) at a side to be radially reduced from the other side not to be radially reduced. This is because, in such a case, the rectangular tube (10) compressed by pressure is radially reduced while shifting from the side not to be radially reduced toward the side to be radially reduced due to plastic flow. As a result, not only a crimp likely to be generated on the radially reduced portion can be further suppressed, but also further amount of radially reduced portion can be achieved if such an amount is requested. In consideration of plastic flow of the rectangular tube (10), it is preferable that the relative positions of the flat rolls (40*a*, 40*b*) with respect to the rectangular tube (10) shift in a direction against a rotation direction of the flat rolls (40*a*, 40*b*).

Means for shifting the V-shaped rolls (30*a*, 30*b*) used in forming the V-shaped grooves at one end of the rectangular tube (10) (pressure means) does not need to be limited in particular. It is sufficient if it is capable of forming V-shaped grooves having predetermined dimensions on the rectangular tube (10). Likewise, means for shifting the flat rolls (40*a*, 40*b*) used in radially reducing the end of the rectangular tube (10) (pressure means) does not need to be limited in particular. It is sufficient if it is capable of processing the rectangular tube (10) to predetermined dimensions.

The end of the rectangular tube (10) may be radially reduced by means other than the flat rolls (40*a*, 40*b*) if the outside diameters of the tubes that press against the outer surfaces (10*a*-10*d*) of the rectangular tube (10) are substantially constant. Possible convex portions or concave portions formed at the parts not touching the outer surfaces (10*a*-10*d*) of the rectangular tube (10) do not affect the radially reducing process of the end of the rectangular tube (10).

The manufacturing equipment according to the present invention consists of two stands, specifically a roll stand having upper and lower V-shaped rolls for preliminary forming and a roll stand with upper and lower flat rolls for radially reducing. In the radially reducing process of the rectangular tube (10), an internal die is inserted into the rectangular tube (10) at one end thereof, and the one end is inserted into the roll stand for preliminary forming and pressed by the V-shaped rolls to form the V-shaped grooves on the outer surfaces of the rectangular tube (10) in the longitudinal direction thereof. Subsequently, the end having V-shaped grooves formed thereon of the rectangular tube (10) is inserted into the roll stand for radially reducing and pressed by the flat rolls to form a radially reduced end.

The rolls of the respective roll stands are arranged so as to interpose the rectangular tube (10) therebetween (from the upper side to the lower side in FIGS. 1-6). In such a configuration, two opposite surfaces of the rectangular tube (10) are processed simultaneously, and thereafter, the rectangular tube (10) is rotated around the longitudinal direction thereof as a center of rotation before the not-yet-processed surfaces are processed. Accordingly, the manufacturing equipment to realize the present invention consists of only two roll stands and a device for rotating and shifting the rectangular tube (10), thereby enabling the reduction of equipment costs. The drawings for the background of the invention show V-shaped rolls and flat rolls arranged so as to interpose a rectangular tube therebetween from the upper side to the lower side, but the rectangular tube can also be interposed from other directions between such rolls. It is acceptable if the V-shaped rolls as well as the flat rolls interpose a rectangular tube between both sides.

EXAMPLES

For the radially reducing process according to the present invention, rectangular tubes each having 45 mm×45 mm in rectangular cross-section were used. The material for these rectangular tubes was 3.2-mm-thick high-strength steel plates with a tensile strength of 400 MPa. The V-shaped rolls had an outside diameter of 50 mm and a width of 100 mm.

The V-shaped roll has a convex portion at the middle part in a width direction, which has a width of 28 mm, slope length of 20 mm, and inclined angle of 45 degrees. The flat rolls had an outside diameter of 50 mm and a width of 100 mm. The internal die had four V-shaped concave portions on the surface, which measured 5 mm in depth and 10 mm in width.

V-shaped grooves are formed on the outer surfaces of the rectangular tube on a V-groove forming stand. An internal die is inserted into the rectangular tube at one of the ends thereof, and the end was pressed against by V-shaped rolls rotating at a rate of 20 rpm from opposite outsides through the use of hydraulic cylinders to form V-shaped grooves that measured 5 mm in depth, 10 mm in width, and 100 mm in length. In the V-shaped groove forming, two opposite surfaces of the rectangular tube were processed simultaneously, and thereafter, the rectangular tube was rotated 90 degrees before V-shaped grooves were formed on the other two surfaces.

Subsequently, the rectangular tube was inserted into the roll stand for radially reducing, where two surfaces of the V-shaped groove rectangular tube at the end thereof were pressed by flat rolls rotating at a rate of 20 m/min from opposite outsides through the use of hydraulic cylinders. Subsequently, the 100-mm-long end part of the rectangular tube was radially reduced to 38 mm×38 mm. For comparison, the same rectangular tubes and flat rolls as described above were used, and the rectangular tube having the V-shaped grooves not formed on the surfaces thereof was inserted into the roll stand to radially reduce the 100-mm-long end part of the rectangular tube to 38 mm×38 mm by pressing the rotating flat rolls. The formed radially reduced ends were compared with each other. The radially reduced ends formed according to the present invention had flat outer surfaces of the defined dimensions. Meanwhile, the radially reduced ends formed for comparison partly failed to meet the defined dimensions due to the crimp generated on the outer surfaces.

REFERENCE NUMERALS

10 rectangular tube
20 internal die
30*a*, 30*b* V-shaped roll
35*a*, 35*b* convex portion
40*a*, 40*b* flat roll
O1, O2 rotation center line of V-shaped roll
O3, O4 rotation center line of flat roll

What is claimed is:

1. A method of manufacturing a rectangular tube having a stepped portion comprising a series of sequential steps comprising:

a first step of forming V-shaped grooves on the rectangular tube on a first pair of opposing surfaces and a second pair of opposing surfaces of an end thereof in a direction parallel to a longitudinal direction thereof; and after the first step, a second step of successively pressing each of the surfaces having the V-shaped grooves formed thereon with a rotating roll from outside to inside such that the first pair of opposing surfaces are compressed, while the second pair of opposing surfaces are not being compressed, to thereby close the V-shaped grooves on the second pair of opposing surfaces, and thereafter, the second pair of opposing surfaces are compressed, while the first pair of opposing surfaces are not being compressed, to thereby close the V-shaped grooves on the first pair of opposing surfaces, in a sequential manner, whereby the end of the rectangular tube is radially reduced, as the stepped portion of a rectangular cross-sectional shape.

2. The method of manufacturing the rectangular tube having the stepped portion according to claim 1, wherein said forming of the V-shaped grooves on the rectangular tube at the surfaces of the end thereof comprises:

placing an internal die having a V-shaped concave portion formed thereon inside the end of the rectangular tube;

placing a V-shaped roll having a V-shaped convex portion formed thereon at a position that is opposite to the concave portion and is outside the end of the rectangular tube; and pressing the V-shaped roll against the rectangular tube at each of the surfaces of the end thereof while causing the V-shaped roll to rotate.

3. The method of manufacturing the rectangular tube having the stepped portion according to claim 1, wherein said end of the rectangular tube is radially reduced by:

shifting a relative position of the rotating roll with respect to the rectangular tube in a longitudinal direction thereof while keeping a status that the rectangular tube is pressed with the rotating roll from outside to inside.

4. The method of manufacturing the rectangular tube having the stepped portion according to claim 2, wherein said end of the rectangular tube is radially reduced by:

shifting a relative position of the rotating roll with respect to the rectangular tube in a longitudinal direction thereof while keeping a status that the rectangular tube is pressed with the rotating roll from outside to inside.

* * * * *